United States Patent [19]

Newell et al.

[11] 4,160,424

[45] Jul. 10, 1979

[54] STITCH COUNTER FOR A SEWING MACHINE

[75] Inventors: Robert C. Newell, Hillsdale; Robert F. Kinning, Rutherford, both of N.J.

[73] Assignee: Dan River Incorporated, Danville, Va.

[21] Appl. No.: 877,184

[22] Filed: Feb. 13, 1978

[51] Int. Cl.[2] ..... D05B 69/22; D05B 69/20

[52] U.S. Cl. ..... 112/275

[58] Field of Search ..... 112/121.11, 275, 277, 112/121.12, 210

[56] References Cited

U.S. PATENT DOCUMENTS

| | | | |
|---|---|---|---|
| 3,074,632 | 1/1963 | Braun et al. | 112/121.11 X |
| 3,750,603 | 8/1973 | Martin | 112/121.11 X |
| 3,827,381 | 8/1974 | Baanstra et al. | 112/210 X |

*Primary Examiner*—Peter Nerbun

*Attorney, Agent, or Firm*—Fisher, Christen & Sabol

[57] ABSTRACT

A stitch counter is disclosed for use on a sewing machine to count a predetermined number of stitches before stopping the machine and actuating the thread cutting mechanism. The counter is used in conjunction with existing control circuitry which includes a light beam generator and receiver located in front of the needle. The cloth being sewn interrupts the light beam, which allows the operator to select any sewing speed. The completion of the light beam after the end of the cloth passes, shifts the machine to a pre-set sewing speed and activates the stitch counter. The counter counts a number of pulses from a pulse generator on the machine, which are indicative of the number of stitches, before stopping the machine and actuating the thread cutter.

6 Claims, 2 Drawing Figures

STITCH COUNTER FOR A SEWING MACHINE

FIELD OF THE INVENTION

The present invention relates to apparatus for controlling the operation of a sewing machine, more particularly apparatus for counting a predetermined number of stitches.

BRIEF DESCRIPTION OF THE PRIOR ART

It is well known in the prior art to control the sewing speed of a sewing machine by manually positioning the control switch in the proper position. Typically, the control switch is either a foot pedal or a knee operated lever. It is imperative that the machine operator slow down the sewing speed as the end of the seam is approached to avoid tangling or breaking the thread.

In a domestic sewing machine, the operator can readily use the existing foot pedal or knee operated lever to control the speed. However, to achieve maximum machine efficiency in a commercial sewing operation, means must be provided to automatically switch the machine to a slower speed at the proper time. Switching to the slower speed too soon results in an inefficient usage of the machine, while switching too late results in tangled or broken thread.

Various systems are known to achieve this automatic speed switching for the sew-off portion of the cycle. One of these, commonly known as the two-light system, utilizes a pair of light beams to actuate an automatic speed control mechanism. The light beams are positioned such that one is in front and one is in back of the reciprocating needle. When the front light beam is interrupted by the operator placing the cloth in position to be sewn, the machine may be operated at any speed by the operator. When end of the cloth clears the first light beam, the machine automatically switches to the slower, sew-off speed. As the cloth goes past the reciprocating needle, it interrupts the second light beam. When the end of the cloth clears the second light beam, the machine stops and a cutter device cuts the thread and the machine is ready for another sewing operation. This system has proven to be somewhat deficient in actual usage since the lights and light receivers become covered with lint and dust thereby rendering them inoperable. Also, if the operator inserts a second cloth into the sewing machine before the first cloth has cleared the second light beam, the machine may be operated at the higher speed, due to the interruption of the first lightbeam, which causes tangling or breaking of the thread before it can be cut off.

Another prior art system uses a single light beam positioned in front of the needle assembly and a timer device. As in the previously described system, when the front light beam is interrupted by placing the cloth in the sewing position, the machine may be operated at any speed by the operator. As the end of the cloth clears the light beam, the machine automatically switches to a pre-set slower speed and the timer device is started. The timer circuitry causes the machine to run at the slow speed for a pre-set time. At the end of this time the thread cutter is actuated to cut the thread and the machine is again ready for another sewing operation. This system would be acceptable if all machine operators worked at the same speed. However, this is obviously not the case. Where a quick operator uses such a machine, he must wait until the expiration of the pre-set time before the machine may be operated at full speed.

This penalizes the quick worker and results in inefficient usage of the machine. It is also impractical to adjust each machines' pre-set time to suit the individual operator, since the same operator does not always use the same machine.

The following U.S. patents are illustrative of the state of the sewing machine art: U.S. Pat. Nos. 3,972,297; 3,970,016; 3,693,564; 3,687,097; 3,425,369; 3,199,479; 3,442,236; 3,893,402; and 3,994,246.

SUMMARY OF THE INVENTION

The present invention relates to apparatus for controlling the operation of a sewing machine. More particularly, such apparatus counts a pre-determined number of stitches during the sew-off portion of the sewing cycle before stopping the machine and actuating the thread cutter.

The operation of the stitch counting apparatus is initiated by completion of a light beam between a light beam generator and receiver located in front of the sewing needle assembly. The location of the light beam generator and receiver is such that the light beam is interrupted when the cloth is placed on the machine in a position ready for sewing. This allows the operator to select any sewing speed he desires. When the end of the cloth passes from between the generator and receiver, thereby completing the light beam, the machine automatically switches to a pre-set, slower speed. Completion of the light beam also initiates the stitch counting circuit.

The circuit counts a pre-selected number of electrical pulses, corresponding to the number of stitches, from a pulse generator which may be driven by the sewing machine main shaft. After counting the set number, the counter stops the machine and actuates the thread cutter.

DETAILED DESCRIPTION OF THE PREFERRED EMBODIMENT

Figure 1:
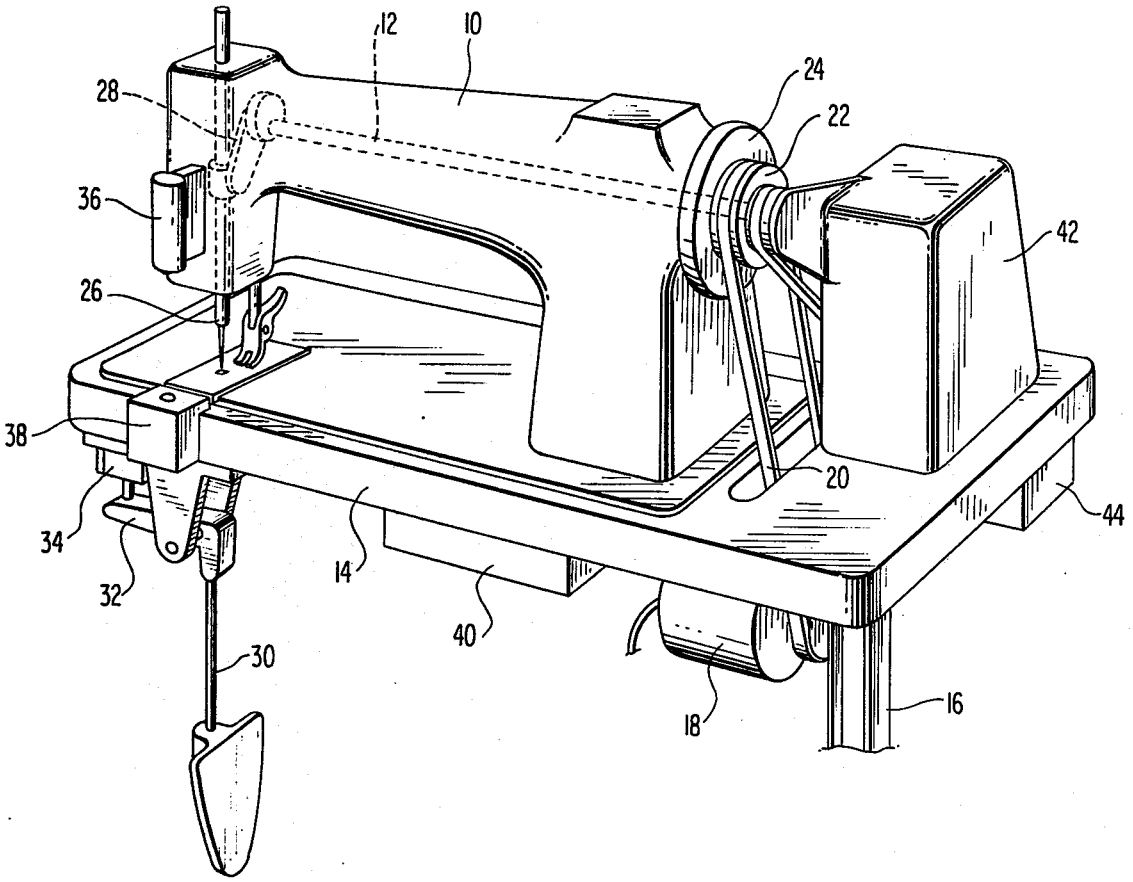
FIG. 1 is a perspective view of a sewing machine.

The stitch counting apparatus according to the invention is utilized in conjunction with a known sewing machine structure. Typically, such structure comprises a sewing machine head 10 having main shaft 12 rotatably mounted therein and being mounted on base 14. Base 14 may have legs 16 extending downwardly therefrom to support the machine at a comfortable operating height. Motor 18 is also attached to base 14 and drives main shaft 12 via belt 20 and sheave portion 22 of handwheel 24. Handwheel 24 is, in turn, attached to main shaft 12. Needle assembly 26 is reciprocally mounted in machine head 10 and caused to reciprocate vertically by crank mechanism 28 attached to main shaft 12. Thus, as can be seen, rotation of the output shaft of motor 18 rotates main shaft 12 which causes needle assembly 26 to reciprocate vertically. The operation and speed of motor 18 is controlled by knee actuated lever 30 pivotally attached to base 14 via arm 32. The lateral portion of arm 32 bears against, and actuates variable speed switch 34 which is electrically connected to motor 18. By moving lever 30 with his knee, the operator can actuate motor 18 and control the sewing speed by controlling the speed of motor 18.

The foregoing describes the basic operational features of a standard, known sewing machine. No description has been given of the thread supply, thread cutter, or cloth feed since these are standard devices well known by anyone having reasonable skill in the sewing machine art. Suffice to say, the function of these elements is not altered by this invention and it is understood that all may be included with the aforedescribed sewing machine. It is also understood that other known means of controlling motor 18 may be used, such as a foot treadle, instead of knee lever 30 without exceeding the scope of this invention.

In addition to the manual motor control means heretofore described, the machine also has means to automatically shift to a slower speed at a predetermined point in its operational cycle. This means includes light beam generator 36 and light beam receiver 38 positioned in front of needle assembly 26 such that placement of the cloth in the sewing position interrupts the light beam. Known logic circuitry, shown diagrammatically at 40, which may be attached to base 14 is electrically connected to light beam receiver 38, switch 34 and motor 18 such that when the light beam is interrupted, the motor may be operated at any speed by the machine operator.

When the rear portion of the cloth being sewn passes beyond the receiver 38 toward the needle assembly 26, completion of the light beam causes light beam receiver 38 to generate an electrical signal to circuitry 40. Circuitry 40 then causes motor 18 to run at a predetermined speed which may not be controlled by the machine operator. The output signal from light beam receiver 38 is also used to actuate the stitch counting circuit which will hereinafter be described in detail. Box 42 diagramatically represents a tachometer/generator unit driven by main shaft 12. Unit 42 is a standard, commercially available tachometer/generator (such as a Variostop Synchronizer made by Teledyne Amco of Reading, Pa.) and need not be described in detail. It may be driven via a belt connection to handwheel 24, or may be attached to and driven directly by the handwheel. Unit 42 generates a number of electrical pulses for each revolution of shaft 12. In one practical application, unit 42 generates 36 pulses/revolution which pulses are used to control various aspects of the machine, such as motor speed, etc. via aforementioned control circuit 40. One pulse per revolution, upon which a hi-frequency signal is modulated, corresponds mechanically to the desired needle position. This pulse is used by control circuit 40 to stop the machine when the needle is at the desired position.

Figure 2:
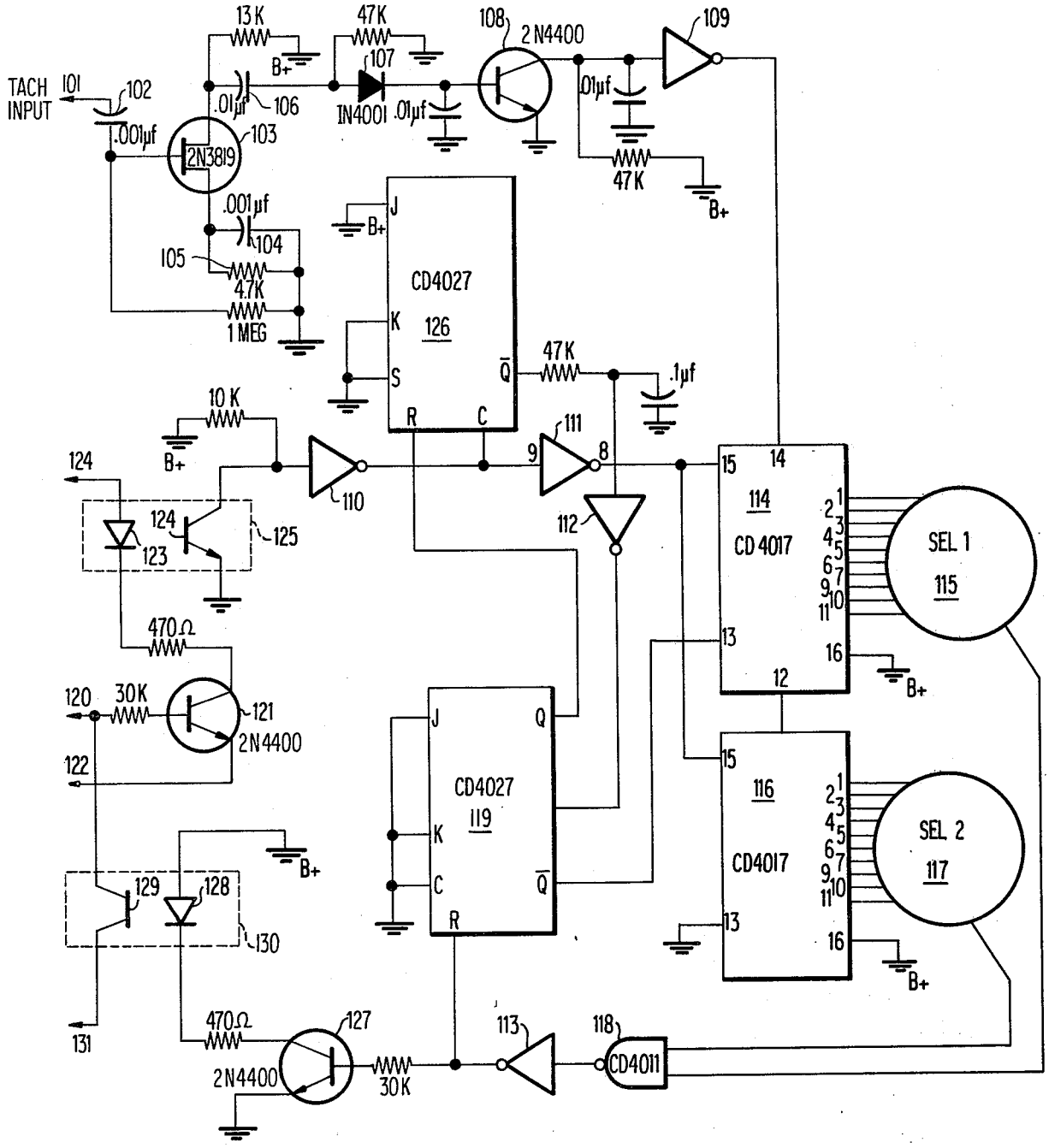
FIG. 2 is a circuit diagram of a stitch counting circuit according to the present invention.

All of the foregoing description relates to apparatus and control circuitry which are either known in the art or are standard, commercially available items. The novel stitch counting circuit according to this invention is schematically shown in FIG. 2. All of the components incorporated in the circuitry are mounted on a single printed circuit board including a ground bus electrically connected to the sewing machine motor ground and a B+ bus electrically connected to the positive 12 volt DC source at the motor.

The circuit is responsive to the modulated pulse signal generated by the tachometer/generator unit 42 previously described. The pulsating signal is therefore a function of the stitch rate of the machine and it is applied to tachometer input 101. A DC isolation capacitor 102 couples tachometer input 101 to the gate of field effect transistor (FET) 103. Each pulse applied to FET 103 causes the transistor to conduct and produce a saw tooth wave pulse train representing the tachometer input. The pulses produced by transistor 103 have a saw tooth shape as a function of the RC circuit comprised of capacitor 104 and resistor 105 connected between the FET drain and ground. The saw tooth wave pulse train output from FET 103 is applied through a DC isolation capacitor 106 and diode 107 to the base of transistor 108 which inverts the pulse train and applies it to Schmitt trigger 109. Schmitt trigger 109 is one of six Schmitt triggers located on an MM74C14 hex Schmitt trigger integrated circuit. Four of the remaining five Schmitt triggers on the integrated circuit are incorporated in FIG. 2 as Schmitt triggers 110, 111, 112, and 113 and their specific function in the circuitry will be explained at a more logical point in this discussion.

Schmitt trigger 109 produces a square wave output at a pulse repetition rate equal to the saw tooth input. This pulse train is applied to the clock input, pin 14 of counter 114 which is a divide-by-10 counter with one-of-ten outputs. The counter is a fully synchronous decade, or divide-by-10 counter that may be used to obtain a one-of-ten decoded output or a square wave output one-tenth the frequency of the input. In the specific application in the circuitry illustrated in FIG. 2 the ten incremental outputs are coupled to individual inputs of a ten input selector switch 115 and the divide-by-10 output at pin 12 is coupled to the clock input, pin 14 of a second divide-by-10 counter 116. The ten incremental outputs of counter 116 are applied to individual inputs of selector switch 117.

Both counters 114 and 116 advance one count on the positive edge (ground to positive transition) of a pulse train input at the clock input or pin 14 and on any count, the decoded output or incremental output goes positive and the other outputs remain at ground. Thus counter 114 functions as a selectable units digit counter through selector switch 115 and counter 116 functions as a selectable tens digit counter through selector switch 117. Selector switches 115 and 117 couple a selected positive pulse from their respective counters to inputs of the two input NAND gate 118 which will produce a high or positive pulse whenever both inputs are positive. This represents a predetermined number of pulses originating at the tachometer input 101 commencing from the time that both counters are enabled by a ground potential at enable input 13 and reset by a positive resetting pulse at the reset inputs on pin 15.

Counter 116 is always enabled because the enable input pin 13 is tied to ground but this counter will only count after counter 114 has registered an input of ten pulses and counter 114 is only enabled when J-K flip-flop 119 is set and the ground at the K input is reflected at the $\overline{Q}$ output.

The sequence of operation involved in enabling and resetting counters 114 and 116 commences when light beam receiver 38 senses that material has passed out of the immediate sewing area by completion of the light beam and generates a signal at input 120. This signal is applied to the base of transistor 121 which has its emitter coupled to the negative bus of the sewing machine control logic card and its collector connected to the positive bus of the sewing machine logic card via light emitting diode 123 and input pin 124. When transistor 121 conducts, light emitting diode 123 becomes illuminated and the photoresponsive portion 124 of photo isolator 125 becomes conductive. This causes Schmitt trigger 110 to produce a positive pulse that clocks J-K flipflop 126 and causes the ground potential at the K input to be applied to the $\overline{Q}$ output. The output of Schmitt trigger 110 is also applied to the input of Schmitt trigger 111 and the trailing edge of the input causes 111 to produce a positive output pulse which resets counters 114 and 116.

The positive going trailing edge of the low output pulse produced at $\overline{Q}$ of flipflop 126 causes a positive pulse to be produced by Schmitt trigger 112 which is applied to the set input of flipflop 119 causing the $\overline{Q}$ output of that flipflop to go low and remain low until reset. The low output at the $\overline{Q}$ output of flipflop 119 enables counter 114 as previously discussed. The Q output of flipflop 119 is high at this time and it is applied to the reset output of flipflop 126 to reset that flipflop to force the $\overline{Q}$ output to go high and maintain flipflop 119 in the set mode via Schmitt trigger 112.

When counters 114 and 115 have been enabled and reset, they begin counting to a preset number as selected by selectors 115 and 117. When that preset number is reached as indicated by coincidence of the output of both selectors 115 and 117 at the inputs to NAND gate 118, NAND gate 118 produces a positive pulse. The trailing edge of the positive pulse causes Schmitt trigger 113 to produce a positive pulse which resets J-K flipflop 119, removing the enabling negative potential at the $\overline{Q}$ output to disable counter 114 and providing a negative output at the Q output to reset flipflop 126 so that the circuitry will be in condition to respond to another input through photo isolator 125. Schmitt trigger 113 also causes transistor 127 to conduct, which causes light emitting diode 128 to become illuminated and cause the photo responsive half 129 of photo isolator 130 to become conductive. This creates a return signal path from the photocell input 120 to the motor control input 131 which causes sewing machine to stop via control circuit 40, which also stops the pulse input at tach input 101. The circuit is now in condition to repeat the control function just described if cloth is placed in the machine to block the light beam and the sewing machine is started. In this case the sewing machine will continue to function until cloth passes by light beam receiver 38 and then the circuitry of FIG. 1 will commence to count stitches as previously described and turn the sewing machine off.

The circuit according to the invention may be mounted at any convenient location on the machine or the base. For illustrative purposes, it is shown as being attached to the underside of base 14 at 44.

We claim:

1. In a sewing machine having a reciprocating needle actuated by a main shaft; a motor drivingly connected to said shaft; and means to control the operation and speed of said motor, the improvements comprising:

(a) pulse generating means driven by said main shaft, the number of pulses generated being proportional to the number of stitches of said sewing machine;

(b) electrical circuit pulse counting means to count the number of pulses generated by said pulse generating means;

(c) detecting means to detect the end of the cloth being sewn and generate an electrical signal when the end is detected, said generated electrical signal actuating said electrical circuit pulse counting means;

(d) selector means to select the number of pulses to be counted electrically connected to said electrical circuit pulse counting means so as to produce an output signal when the selected number of pulses are counted;

(e) reset means electrically connected to said detecting means to reset and enable said electrical circuit pulse counting means upon receipt of an electrical signal from said detecting means; and (f) means responsive to electrical signals from said electrical circuit pulse counting means to produce an output signal which stops the sewing machine when the selected number of pulses have been counted, said means comprising:

(i) a NAND gate electrically connected to the output of said selector means so as to produce an output signal when a signal is received from all selector means, (ii) transistor means electrically connected to the output of said NAND gate such that the transistor means becomes conductive upon receipt of an electrical signal from said NAND gate; and (iii) photo isolator means electrically connected to said detecting means and said transistor means such that upon receipt of an electrical signal from said transistor means, said photo isolator means becomes conductive and creates a return signal path from said detecting means to the motor, thereby causing said motor to stop.

2. The improved sewing machine of claim 1 wherein said pulse generating means comprises a tachometer/generator driven by said main shaft having at least one pulse per revolution upon which a high-frequency signal is modulated.

3. The improved sewing machine of claim 2 wherein said tachometer/generator generates 36 pulses per revolution and one pulse upon which a high-frequency signal is modulated.

4. The improved sewing machine of claim 3 wherein said one pulse corresponds to the position of the reciprocating needle.

5. The improved sewing machine of claim 2 wherein said electrical circuit pulse counting means counts only those pulses upon which a high frequency signal is modulated.

6. The improved sewing machine of claim 1 wherein said detecting means is a light beam generator.

* * * * *